US008433533B2

(12) United States Patent
Zhao et al.

(10) Patent No.: US 8,433,533 B2
(45) Date of Patent: Apr. 30, 2013

(54) HIGH RESOLUTION SENSOR WITH SCALABLE SAMPLE RATE

(75) Inventors: Jinsong Zhao, Houston, TX (US); Jorge Maxit, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 47 days.

(21) Appl. No.: 12/857,212

(22) Filed: Aug. 16, 2010

(65) Prior Publication Data

US 2011/0022318 A1 Jan. 27, 2011

Related U.S. Application Data

(63) Continuation-in-part of application No. 12/346,604, filed on Dec. 30, 2008, now Pat. No. 8,335, 665.

(60) Provisional application No. 61/234,402, filed on Aug. 17, 2009.

(51) Int. Cl.
*G01R 25/00* (2006.01)
*H04B 3/46* (2006.01)
*G08B 29/00* (2006.01)

(52) U.S. Cl.
USPC ..... 702/79; 375/226; 340/870.2

(58) Field of Classification Search ..... 702/79, 702/1–2, 6, 11–14, 17, 46–47, 69, 75, 78, 702/81, 84–85, 98–99, 104, 106, 127, 130, 702/138, 176, 182–183, 189–190, 193; 73/152.46, 73/152.51; 367/25–27, 69, 78–83; 375/225–227; 340/853.1–853.2, 855.3–855.5, 870.12–870.13, 340/870.18–870.19, 870.2; 331/1 R, 18, 331/23, 34, 40, 44–45, 47, 51
See application file for complete search history.

(56) References Cited

U.S. PATENT DOCUMENTS

| | | | | |
|---|---|---|---|---|
| 3,720,910 | A * | 3/1973 | McLaughlin et al. | 340/855.5 |
| 3,991,611 | A * | 11/1976 | Marshall et al. | 340/855.5 |
| 4,179,670 | A | 12/1979 | Kingsbury | |
| 4,909,075 | A | 3/1990 | Flaum et al. | |
| 6,606,565 | B1 | 8/2003 | Strickland et al. | |
| 6,907,553 | B2 | 6/2005 | Popplewell et al. | |
| 7,293,054 | B2 * | 11/2007 | Clements et al. | 708/252 |
| 7,313,052 | B2 | 12/2007 | Fincher et al. | |
| 2009/0033913 | A1 | 2/2009 | Mott | |

* cited by examiner

*Primary Examiner* — Toan Le
(74) *Attorney, Agent, or Firm* — Cantor Colburn LLP

(57) ABSTRACT

Apparatus and methods of providing a selected sample rate for sensor measurements are provided, which in one aspect may include a circuit configured to receive sensor signals as a first series of count rates corresponding to sensor the sensor measurements, each count rate representing a value of a parameter of interest, at least two accumulators configured to alternately accumulate the count rates in the series of count rates over a time period that corresponds to a selected sample rate and a controller configured to control the time periods for the at least two accumulators.

20 Claims, 6 Drawing Sheets

HIGH RESOLUTION SENSOR WITH SCALABLE SAMPLE RATE

CROSS-REFERENCE TO RELATED APPLICATIONS

This application is a continuation-in-part to the U.S. patent application having the Ser. No. 12/346,604, filed Dec. 30, 2008. This application also claims priority from the U.S. Provisional Patent Application having the Ser. No. 61/234,402 filed Aug. 17, 2009.

BACKGROUND OF THE DISCLOSURE

1. Field of the Disclosure

This disclosure relates generally to apparatus and method for providing high resolution sensor measurements.

2. Background of the Disclosure

Wellbores (also referred to as "boreholes") are drilled in the earth's subsurface formations for the production of hydrocarbons (oil and gas). A variety of measurements, including pressure and temperature measurements, are made while drilling the wellbore and after the wellbore has been drilled. The measurements made during drilling are generally referred to as measurement-while-drilling while measurements made after drilling are generally referred to as well-logging measurements. A downhole tool, generally referred to as the formation testing tool, is used to withdraw formation fluid samples and to take pressure and temperature measurements while logging the well as well as while obtaining the formation fluid samples. Wireline tools also are utilized for pressure and temperature logging. Quartz pressure and temperature sensors are sometimes used to obtain high resolution measurements. Often a trade-off is made between the data resolution and sampling rate. For example, for certain commercially available quartz pressure sensor to obtain a high resolution, such as 0.001 psi, the gate time is often no less that 1 second. When the sampling rate of eight samples per second (for example) is desired, the resolution drops to about 0.01 psi. In some applications, such as during draw down of the formation fluid samples, current downhole tools often use eight samples per second during draw down and fast-build-up phases and then use one sample per second for stable build-up phases. In such measurements, the quantization error (resolution) effect is larger in the areas with a sampling rate of eight samples per second than in the areas with samples of one per second. High quantization error can reduce the data test confidence as well can cause some difficulties during post-processing of the data.

Therefore, there is a need for improved apparatus and method to provide high resolution downhole measurements, including pressure and temperature measurements.

SUMMARY OF THE DISCLOSURE

In one aspect, a method for increasing resolution of a measurement of a sensor is provided, which method in one embodiment may include: receiving a measurement signal from a sensor having a plurality of signal cycles; reducing phase noise from the plurality of signal cycles and providing a series of count rates having reduced phase noise; and processing the series of count rates to provide a desired sample rate having reduced phase noise for the sensor measurement. In another aspect, the disclosure herein provides a method for reducing phase noise in a measurement signal that may include: receiving a measurement signal from a sensor, the signal having a plurality of signal cycles; obtaining a count rate for the signal cycle in the plurality of signal cycles using a multiphase counter based on a selected reference frequency to generate a first series of count rates corresponding to the plurality of signal cycles; and reducing phase noise in the measurement signal using the first series of count rates. In another aspect, the disclosure provides a scalable sample rate of the phase noise reduced data for use by a system, such as the surface system during wellbore operations.

In another aspect, the disclosure herein provides an apparatus that may include a frequency generator configured to provide reference frequency signals; and a multiphase counter configured to provide a count rate for each timing signal corresponding to a plurality of signal cycles of a measurement signal obtained from a sensor, using the reference frequency. In another aspect, the apparatus may include a circuit configured to provide scalable sample rates using the count rates provided by the provided by a circuit that includes multiphase counters.

Examples of certain aspects of a method and an apparatus for reducing phase noise of a measurement signal have been summarized rather broadly in order that the detailed description thereof that follows may be better understood and in order that the contributions they represent to the art may be appreciated. There are, of course, additional features of the disclosure that will be described hereinafter and which will form the subject of claims of this application.

BRIEF DESCRIPTION OF THE FIGURES

For detailed understanding of the various features of the apparatus and methods described herein, reference should be made to the following detailed description, taken in conjunction with the accompanying drawing in which like elements are generally designated by like numerals and wherein.

DETAILED DESCRIPTION OF THE DISCLOSURE

The disclosure herein is described in reference to a wireline formation testing tool that may measure pressure and temperature in a wellbore for ease of explanation. The various aspects of the disclosure herein apply equally to other sensor measurements. The tool shown and described may be utilized alone in a wellbore or it may be run as a part of a wireline tool string that includes other wireline logging tools. The tool may also be a part of a drilling assembly for taking measurements during drilling of the wellbore. Additionally, the specific embodiments described herein are not to be construed as limitations.

Figure 1:
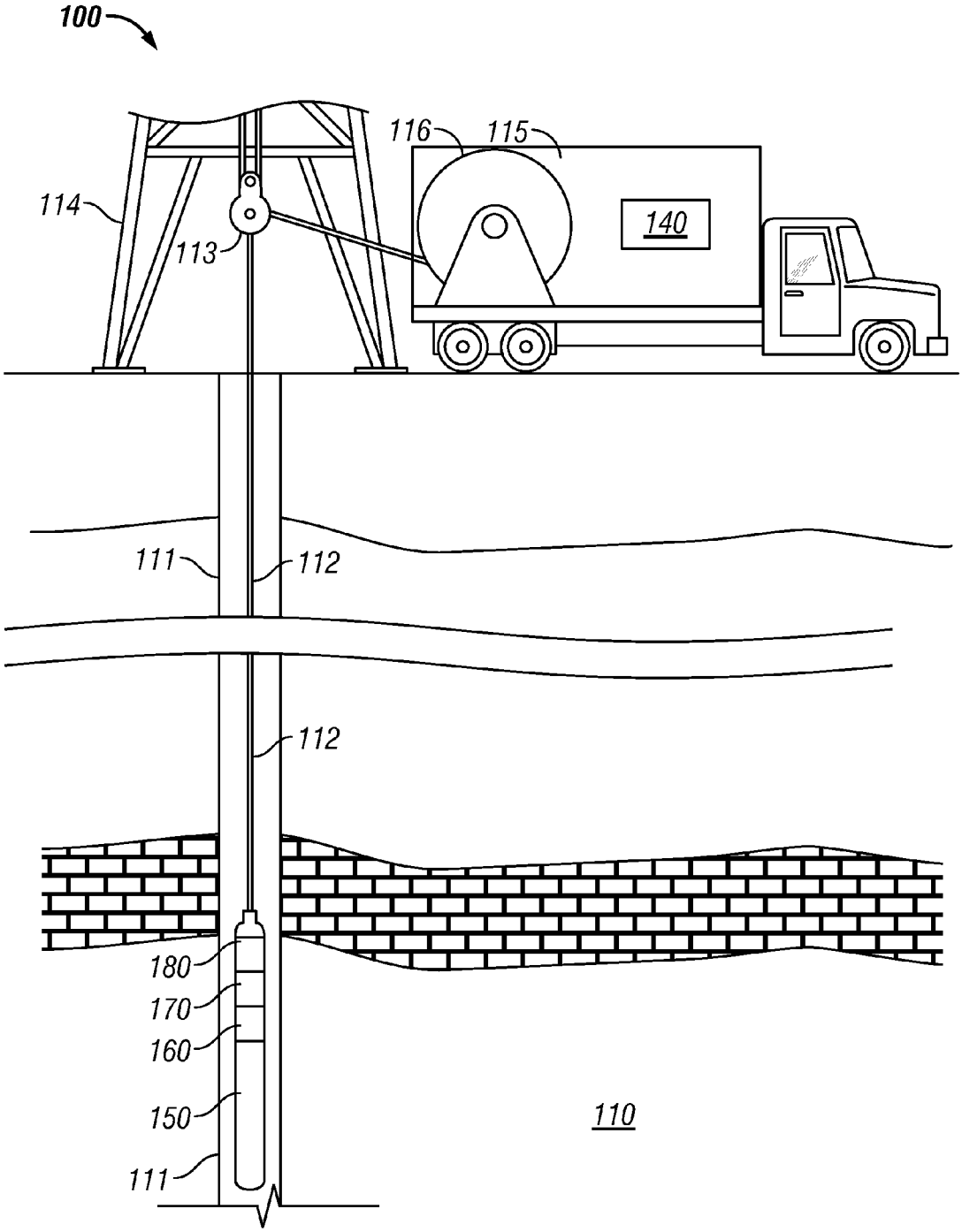
FIG. 1 is a schematic illustration of a formation evaluation tool conveyed in a wellbore for obtaining downhole measurements, including pressure and temperature measurements according to one embodiment of the disclosure.

FIG. 1 is a schematic diagram of wireline system 100 configured to make downhole measurements, such as pressure and temperature, using a pressure and temperature gauge, such as a quartz gauge. The apparatus and methods disclosed herein equally apply to such gauges used to make measurements during drilling of the wellbores. Additionally, the methods and apparatus described herein relating to reducing phase noise described herein may be utilized to reduce phase noise of any other sensor measurements. The system 100 is shown to include a downhole tool 150 conveyed into a wellbore 111 formed in an earth formation 110. The tool 150 may be conveyed in the wellbore alone or as apart of a tool string by a suitable conveying member 112, such as a wireline or tubing. The tool 150 may be conveyed into the wellbore 111 from the surface by a surface rig 114 using a winch 116 placed on a surface unit 115 (such as a truck) and a pulley 113 placed on the rig 114. A tubing-conveyed system will generally include an injector (not shown) to convey the tubing and the tool 150 in the wellbore 111. Offshore systems will include a wireline unit or an injector stationed on an offshore rig. Power to the tool 150 and data communication between the tool 150 and the surface unit 115 may be provided via suitable conductors in the conveying member 112. The surface unit 115 may include a control unit or controller 140, which may be a computer-based system, for controlling the operations of the tool 200. Controller 140 further may include a processor 142, one or more data storage devices 144, such as magnetic tapes, solid state memories, hard dicks, etc. configured to store data and computer programs 146 accessible to the processor 142; data input devices, such a keyboards (not shown); display devices (not shown), such as monitors; and other circuitry configured to control the operations of the tool 150 and to process data received from the tool 150. The tool 150 may be utilized to take measurements, such as pressure and temperature, continuously or substantially continuously while logging the wellbore 111 or at selected locations. Often, such measurements are made for a selected time period at selected downhole locations of wellbore depths during drawdown of the fluid samples from the formation to perform reservoir analysis. High resolution measurements are often desirable for such analysis. In many tools, high resolution quartz oscillator pressure and temperature sensors are utilized to take such measurements.

Still referring to FIG. 1, the tool 150 is shown to include a sensor 160 that provides measurements of a selected downhole parameter, such as pressure, temperature, or another parameter. A control unit or controller 180 in the tool may control the operation of the tool and process data from the tool 150. The tool 150 may further include a device including programs (referred herein as the "high resolution device" or "high resolution system") configured according to one aspect of the disclosure to increase the resolution of the measurements provided by the sensor 160. In one aspect, the high resolution device 160 may process measurement signals from the sensor 160 in-situ and provide the processed signals to the controller 180 for further processing. The controller 180 may include a processor 182, a data storage device 184, such as a memory device, and programs 186 for use by the processor 182. The processor 182 may process the data received from the high resolution device 170 and transmit the processed data to the controller 140 via a suitable telemetry unit 190. The data from the high resolution device may be processed by the surface controller 140 or by a combination of the downhole controller 180 and the surface controller 140. The high resolution device 160 may be located at any suitable location, including at the surface equipment. The high resolution device and its operations are described in more detail in reference to FIGS. 2-5.

Figure 2:
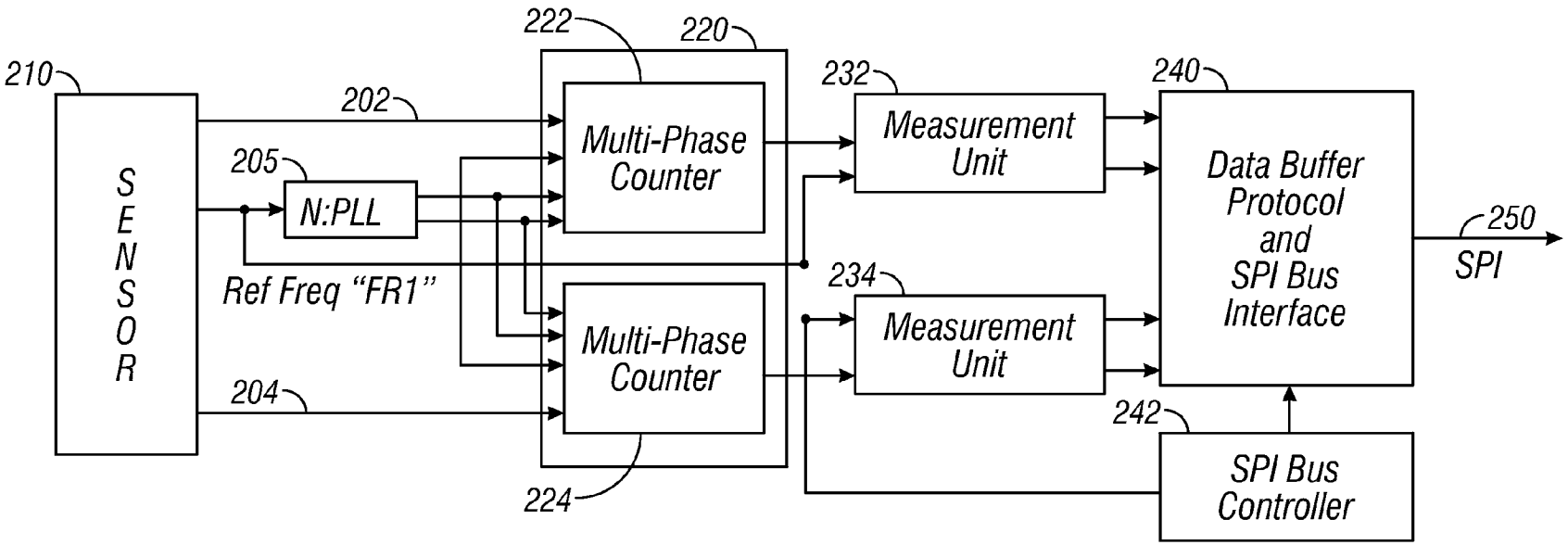
FIG. 2 shows a block diagram of a high resolution measurement system, according to one embodiment of the disclosure.

FIG. 2 shows a block diagram of a system 200 for improving resolution of a sensor measurement according to one embodiment of the disclosure. The system 200 is shown to include a sensor 210 that provides measurement signals for one or more parameters of interest. As an example, system 200 show two measurement signals, one for pressure 202 and the other for temperature 204. Each sensor measurement may be in the form of signals within a predetermined frequency range, such as between 10 KHz and 100 KHz, for example or another suitable frequency range. The sensor 210 may also provide a suitable reference frequency "Fr1." A frequency multiplier or booster 220 may be utilized to boost the reference frequency Fr1 by a selected factor "N," which for the purpose of explaining the system 200 is chosen to be 16. Any other suitable frequency multiplier, however, may be utilized for the purpose of this disclosure. The sensor pressure output signals 202 and temperature output signals 204 and the boosted reference frequency signal 206 are shown as input to a multiphase counting device 220, which may comprise a separate multiphase counter 222 for the pressure measurements 202 and a multiphase counter 224 for the temperature measurements 204. The multiphase counter 220 provides as outputs counts corresponding to the pressure measurements 202 and the temperature measurements 204 based on a reference frequency Fr1, the multiplier N and the number of phases "P" of the counters 222 and 224. Suitable filters 225 and 227 respectively reduce the phase noise associated with the pressure measurements 202 and temperature measurements 204, using the output from the multiphase counters 220 and 224 respectively. Measurement units 232 and 234 respectively reconstruct the pressure measurement signals and temperature measurement signal of the sensor 210 as reduced phase-noise-pressure signals 236 and reduced-phase-noise temperature signals 238. The signals 236 and 238 and the reference frequency 239 of the sensors 210 is fed to a data buffer and bus interface unit 240, which provides the pressure and temperature signals according to a desired protocol, such as a serial protocol. A protocol interface controller 242 controls the data buffer and interface unit 240. The system 200 is described herein in reference to a pressure and temperature measurement for ease of explanation. The system 200, however, is applicable to any sensor measurement and may utilize any number of sensor measurements as the input. The operations of the various components of the system 200 are described in more detail in reference to FIGS. 3-6.

Figure 3:
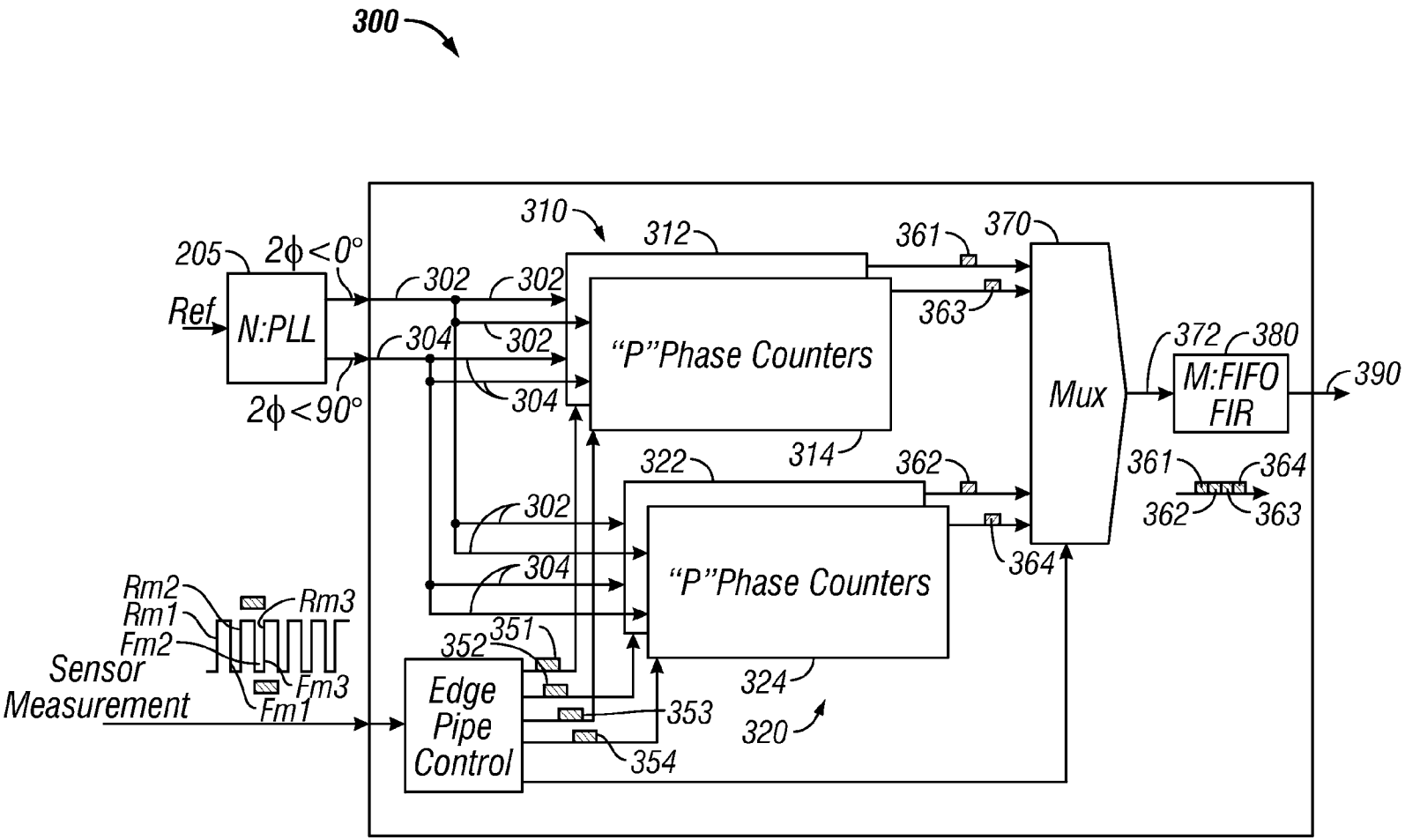
FIG. 3 shows a block diagram of a dual-channel pipelined unit that may be utilized in the system of FIG. 2, according to one embodiment of the disclosure.

FIG. 3 shows a block diagram of multi-channel, multiphase pipelined system 300 that may be utilized to reduce phase noise from the sensor signals 202, 204, etc. For ease of explanation, the system 300 is shown for a single sensor measurement. Furthermore the numerical values relating to the signals, reference frequency, frequency multipliers, time periods, etc. are used for ease of explanation and not as limitations. The system 300 is shown to include two channels 310 and 320, channel 310 having counters 312 and 314 and channel 320 having counters 322 and 324. The reference multiplier 205 generates a reference frequency Fr2=Fr1×N Hz. This Fr2 frequency may further be split corresponding to the rising and falling edges of the cycles of the frequency Fr2 signals, before it is supplied to counters 312 and 314 of channel 310 and counters 322 and 324 of channel 320.

Figure 4:
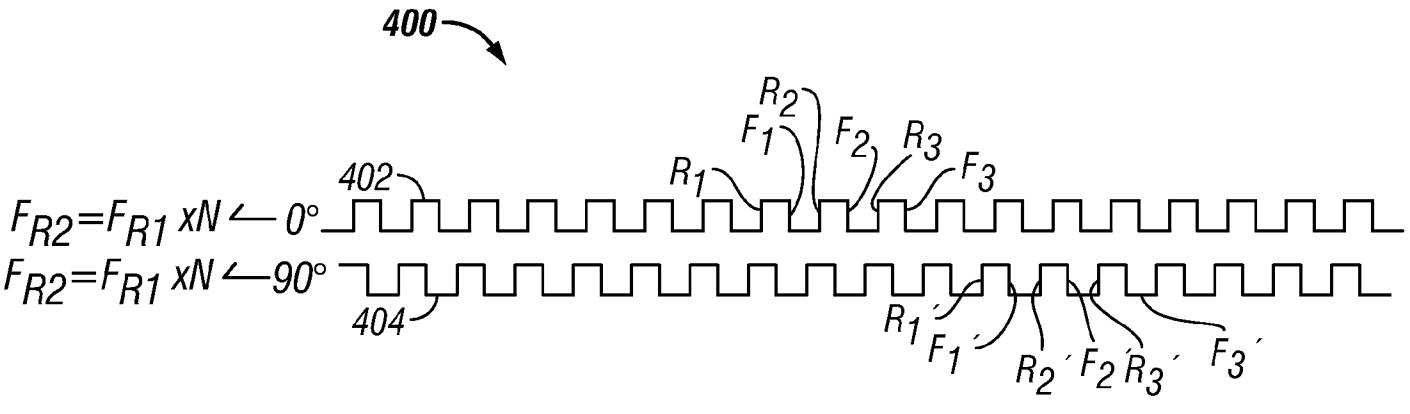
FIG. 4 shows exemplary frequency signals corresponding to rising and falling edges of the reference frequency for use by multiphase counters shown in FIG. 2, according to one aspect of the disclosure.

FIG. 4 shows pulse sequences 402 and 404 corresponding to zero degree and ninety degree phases of the reference frequency Fr2 respectively that may be utilized to generate multiphase frequencies for use by the counters 312, 314, 322 and 324 shown in FIG. 3. In one aspect, the signals supplied to each counter using the pulse sequence 402 may correspond to the rising edges and falling edges of the cycles in the pulse sequence 402. For example, the signals supplied from the sequence 402 may correspond to the rising edges R1-R2, R2-R3, etc and falling edges F1-F2, F2-F3, etc. Thus, in this example there will be two times the signals provided to each counter of each channel corresponding from the pulse sequence Fr2 402 at zero degree phase, as shown by line 302. Similarly, the signals supplied using the pulse sequence 404 corresponding to ninety degree phase may correspond to the rising edges R1'-R2', R2'-R3', etc. and falling edges F1'-F2', F2'-F3', etc. Thus, in this particular example, each counter 312 and 314 in the first channel 310 and each counter 322 and 324 in the second channel 320 will receive four "P" reference frequencies Fr3, two corresponding to the pulse sequence 402 and two corresponding to the pulse sequence 404. Therefore, each of the phase counters 312, 314, 322 and 324 will provide a count based on the frequency Fr3=Fr1×N×P, where Fr1 is the initial reference frequency (such as supplied by the sensor 201), N is the frequency multiplier (such as by the multiplier 210) and P is the number of phases in the multi-phase counter (such as counters 312, 314, 322 and 324). In some applications, the value of N, however, may be zero and the number of phase may be more or less than four. Any suitable frequency multiplier may be utilized, including but not limited to, a phase-locked loop device.

Figure 5:
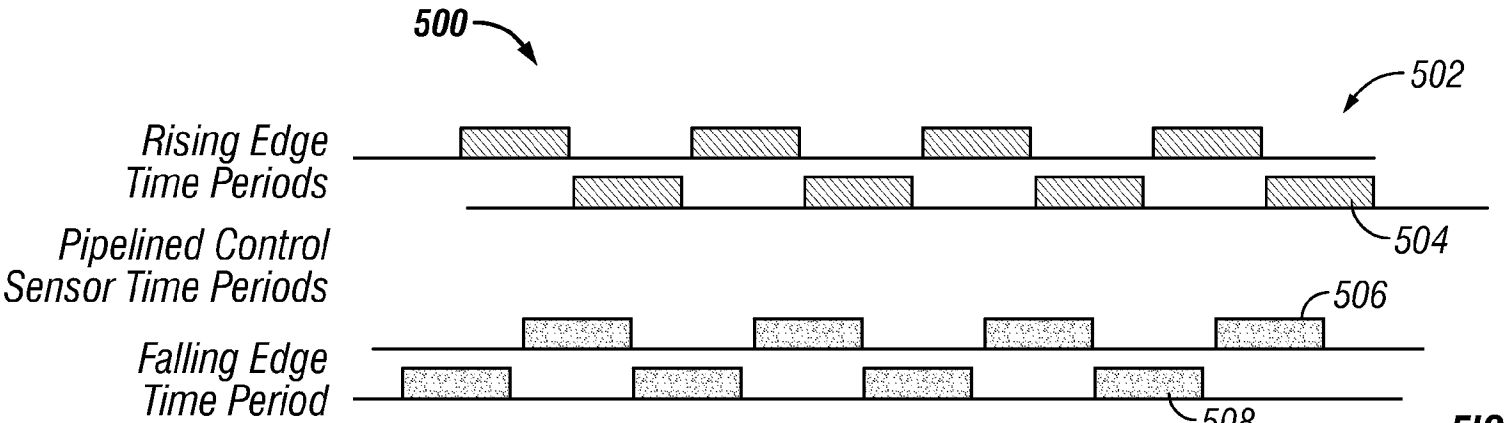
FIG. 5 shows an exemplary timing diagram corresponding to the rising and falling edges of sensor measurement signals that may be utilized for pipelining the measurement signal for use by the system shown in FIG. 2.

Referring back to FIG. 3, the system 300, in one aspect, may pipeline the time periods associated with the sensor measurement signals 315 before sending such time periods to the multi-phase counters 312, 314, 322 and 324. FIG. 3 shows an exemplary signal sequence 340 from the sensor 201 corresponding to a particular measurement, such as pressure, temperature or another desired parameter. In one aspect, a control unit 350 (also referred herein as edge pipeline control unit) may generate timing signals using the measurement pulse sequence 340 and sequentially supply such generated timing signals to the counters. For example the control unit 350 may generate a first timing signal 351 equal to a first rising edge cycle, such as between Rm1 and Rm2 and provide it to the first counter 312 of the first channel 310, the second timing signal 352 equal to the first falling edge cycle between Fm1 and Fm2 and route it to the first counter 322 of the second channel 320, the third timing signal 353 equal to the second rising edge cycle between Rm2 and Rm3 and route it to the second counter 314 of the first channel 310 and the fourth timing signal 354 equal to the second falling edge cycle between Fm2 and Fm3 and route it to the second counter 324 of the second phase counter 320, and so on. In this manner, the control unit 350 may sequence the rising edge timing signals (or rising edge time periods) and falling edge timing cycles (or falling edge time periods) associated with the sensor measurement signals 340 to the multiphase counters 310 and 320. In this particular edge control pipeline example, the number of time periods provided to the phase counters 312, 314, 322 and 324 will be twice the number of time cycles in the sensor measurement signals 240. FIG. 5 shows a timing diagram for the time signals that may be generated and sequenced or pipelined by the control unit 350 according to one aspect of the disclosure. Timing signals 502 and 504 correspond to alternate rising edges while timing signals 506 and 508 correspond to the alternate falling edges of the measurement signals 340. Each phase counter then provides a count for the time period provided thereto based on the reference frequency Fr3=Fr1×N×P. For example counter 312 will provide a count rate 361 for the time period 351, counter 322 will provide a count rate 362 for the time period 352, counter 314 will provide a count rate 363 for the time period 353 and counter 324 will provide a count rate 364 for time period 354 and so on. Since the time periods (such as 351, 352, 353, 354, etc.) provided to the phase counters are twice the number of time periods in the measurement signal 340 (one corresponding to the rising edges and one corresponding to the falling edges), the phase counters will provide twice the count rates compared to the cycles in the measurement signal 340. Also, as an example, when N=16 and P=4, the effective sampling rate of each phase counter will be 16×4=64 times the reference frequency, such as sensor reference frequency. As an example, if the sensor reference frequency is 7.2 MHz, the sampling frequency for the phase counters will be 7.2×16×4=460.8 MHz. A multiplexer 370 may be utilized to sequence the count rates from the phase counters as shown by sequence 372. A filter 380 may be utilized to reduce the phase noise from the count rates 372. The filter, in one aspect, may provide a running average over a selected time period M using a first-in first-out method. Any suitable filter, including but not limited to, a finite impulse response filter, may be utilized for the purpose of this disclosure. The output 390 from the filter 380, i.e., phase noise reduced count rates may be processed to reconstruct the sensor signals having reduced phase noise, as described above in reference to FIG. 2. The output 390 will constitute certain number samples per second, each sample being a numerical value. In the above example, the number of samples in the data stream 390 will equal to the number of signals 202 received from the sensor 210. The data stream 390 may be further processed, such as by the measurement units 232 for the pressure measurements and 234 for the temperature measurements to improve the time domain resolution, as described in more detail with respect FIGS. 6 and 7.

Figure 6:
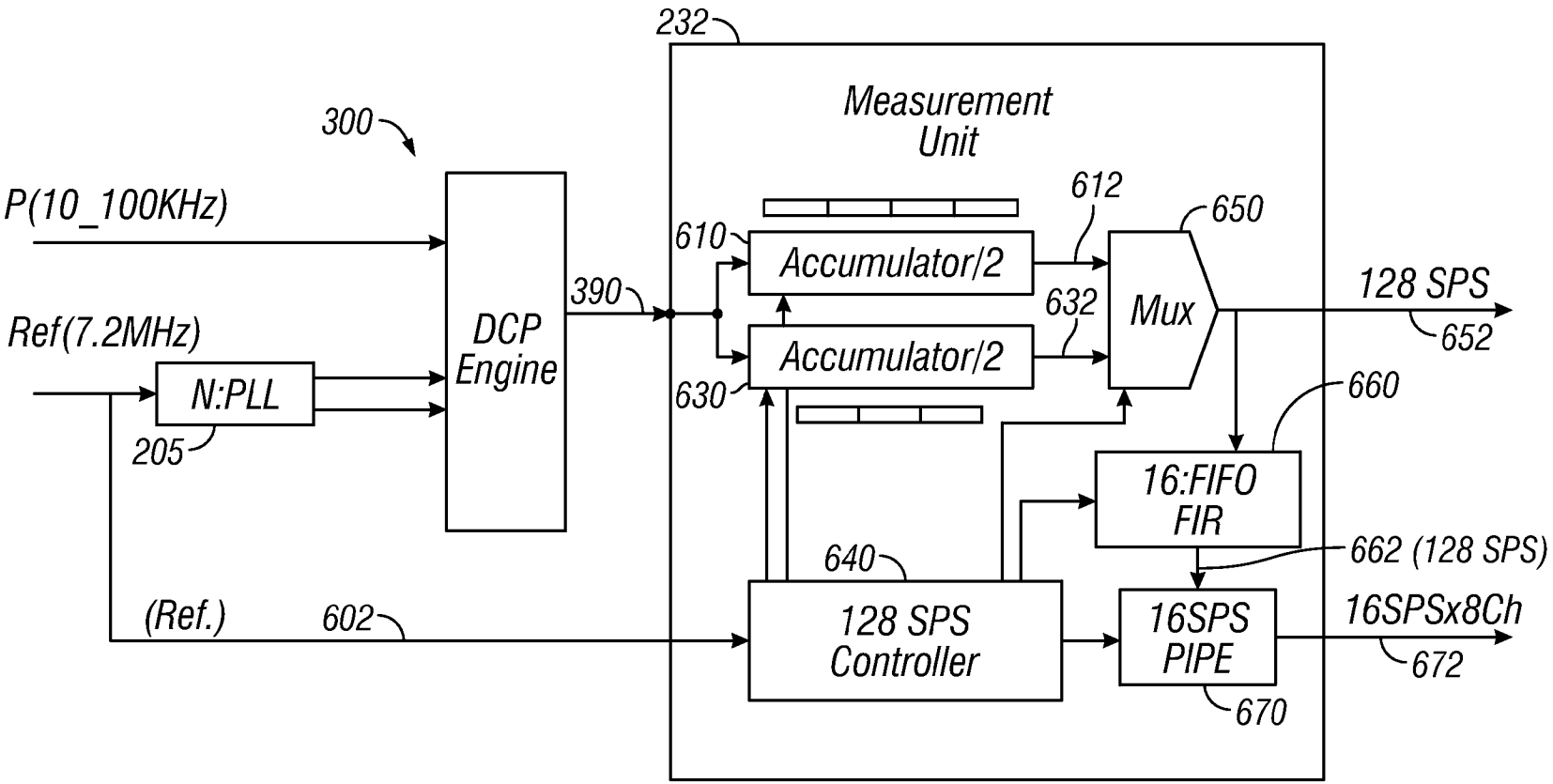
FIG. 6 shows an exemplary embodiment of a measurement unit such as is shown in the measurement system of FIG. 2.

FIG. 6 shows one embodiment of the measurement unit (or circuit) 232 that may be utilized to improve time domain resolution of the pressure measurements. A similar measurement circuit may be utilized for the circuit 234 for the temperature measurement. The exemplary circuit 232 of FIG. 6 is shown to include accumulators 610 and 630 configured to accumulate data stream 390 received from the multiphase counter system 300 (FIG. 3). Each accumulator receives the data stream 390 as one of the inputs. Each sample in the data stream 390 is a numerical count representing a pressure value. A controller 640, using a reference frequency 602, may be used to control the number of samples to be accumulated per second by the accumulators. In one aspect, the reference frequency may be the same as provided by the sensor 210. In the exemplary FIG. 6, the number of samples to be accumulated per second is shown to be 128. The controller 640, in one aspect, may initiate the accumulator 610 to start accumulating the values from the data stream 390 for the first time period, which in this example is 1/128 seconds and then initiate the second accumulator 630 to accumulate the data stream 390 values for the next sample time of 1/128 seconds and continue to alter the accumulation by the accumulators 610 and 630. In one aspect, two accumulators are utilized to allow each accumulator to reset before it is used for the next cycle. The output stream 612 from the accumulator 610 and the output stream 632 from the accumulator 630 are fed to a multiplexer 650. In the example herein, each accumulator generates 64 outputs and thus the multiplexer alternately outputs the signals received from the accumulators 610 and 630 for a total of 128 samples per second, as shown by data stream 652, wherein each such sample is an accumulation of values from the data stream 390 over a selected time period. The data stream 652 is depicted in detail in FIG. 7.

Figure 7:
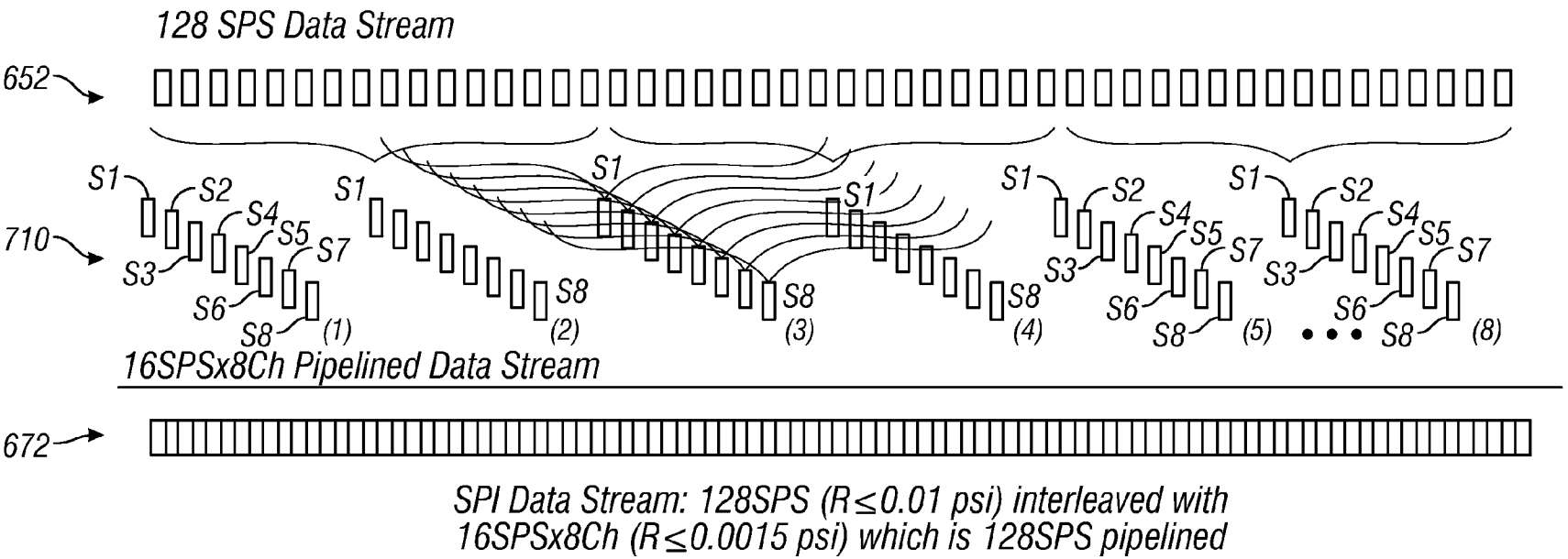
FIG. 7 shows an exemplary output data stream from the system shown in FIG. 3 and the result of pipelining such data stream using the accumulators shown in FIG. 6 to improve time domain resolution, according to one method of the disclosure.

In another aspect, the measurement circuit 232 may further include a finite impulse response (FIR) filter 660 to pipeline the outputs stream 652. In one aspect, the filter 660 may be configured to accumulate a selected number of samples in a first-in-first-out pipeline fashion. In the example of FIG. 6, the FIR filter 660 is shown to accumulate 16 samples. Thus, the FIR filter 660 accumulates the values of the first 16 samples from the data stream 652 and provides a first output, and then accumulates samples 2-17 and provides a second output, and then accumulates samples 3-18 and provides a third output, and continues the process to provide an output that is an accumulation of the most recent 16 inputs to the FIR filter 660 from the data stream 652. Therefore, the output 662 from the FIR filter 660 includes 128 samples per second. Often, the processor 170 in the tool 150 is configured to process a selected number of samples to provide the pressure measurements during logging of the well. In one aspect, the circuit 232 may include a circuit 670 configured to provide the selected number of samples from the stream 662. If tool controller 170 is configured to process, for example, 16 samples per second, the circuit 670 may be configured to select every eighth sample from the data stream 662 to provide stream 672. FIG. 7 shows a spread 710 of eight samples S1 through S8 in consecutive groups (1) through (16). In one aspect, the circuit 670 may be configured to select each of the samples marked S1 from each group to provide the 16 samples to the controller 170. If controller 170 is configured to process 32 samples, then the circuit 670 may be configured to select each of the samples S1 and S4. The circuit 670 may be configured to select any other samples for the purpose of this disclosure. The entire sequence of 128 samples is shown as 710 in FIG. 7. In aspects, the circuit 232 is flexible, in that it is scalable and thus it may be configured to provide any desired number of samples per second after phase noise reduction for use in the system 100 (FIG. 1).

Thus, in one aspect, a method for providing high resolution measurements is provided, which method in one embodiment may include: receiving signals from a sensor that contains a plurality of cycles; and reducing phase noise from the signals received from the sensor by a circuit that provides a count rate corresponding to each cycle in the plurality of cycles. In another aspect, the method may include processing the count rates from the circuit to provide scalable samples per second for use by a processor.

In another aspect, the method may include: receiving measurement signals from a sensor, the measurement signals having a plurality of signal cycles; obtaining a count rate for each signal cycle in the plurality of signal cycles using a multiphase counter based on a selected reference frequency to generate a first series of count rates corresponding to the plurality of signal cycles; and reducing phase noise relating to the measurement signals using the first series of count rates. In another aspect, the method may reduce the phase noise by accumulating a selected number of count rates in a pipeline manner, such as by using a FIR filter. In another aspect, the method may further include: generating a second series of count rates having reduced phase noise; and reconstructing the measurement signals with reduced phase noise using the second series of count rates. The reference frequency may correspond to one of: (i) a reference frequency of the sensor; (ii) a boosted reference frequency of the sensor; and (iii) a frequency generated independent of a sensor reference frequency. In another aspect, the method may further include: generating a plurality of pipelined timing signals representing the plurality of signal cycles; and providing the plurality of the pipelined timing signals to the multiphase counter. In another aspect, generating the plurality of pipelined timing signals may include generating timing signals corresponding to rising edges and falling edges of the signal cycles in the plurality of signal cycles.

In another aspect, the method may further include splitting the reference frequency into a plurality of phases before providing the reference frequency to the multiphase counter. The reference frequency, in one aspect, may be split by generating a frequency corresponding to a zero degree phase and a frequency corresponding to a ninety degree phase. In another aspect, the reference frequency may be split by generating a first frequency signal corresponding to the rising edges of the plurality of signal cycles and a second frequency signal corresponding to the falling edges of the plurality of signal cycles. The phase noise may be reduced by averaging count rates in the second series of count rates over a selected time period. Also, in general, the multiphase counter may sample each timing signal at a rate that equals the product of N times P times the reference frequency of the sensor, where N may be zero or an even integer and P is an even integer.

In yet another aspect, a method is provided to process sensor measurements to generate a selected number of samples. In one aspect, the method may include: selecting a sample rate for the sensor measurements; receiving signals as a first series of count rates corresponding to the sensor measurements, each count rate representing a value of a parameter of interest; alternately accumulating the count rates in the series of count rates by at least two accumulators over a time period that corresponds to the sample rate; and outputting the alternately accumulated count rates to provide sensor measurements corresponding to the selected sample rate as a second series of count rates. In one aspect, each signal in the first series of count rates may be a numerical value of the parameter of interest. In one aspect, the parameter of interest is one of pressure and temperature. The method may further include using a controller to control the time period for each of the at least two accumulators. The method may further include serially accumulating a selected number of the count rates from the second series of count rates on a first-in-first-out basis to provide a third series of count rates. The method may further include selecting the count rates from the third series of count rates as the measured values of the parameter of interest. The first series of count rates may be obtained by receiving signals from the sensor having a plurality of signal cycles, using a multiphase counter based on a reference frequency to generate an initial series of count rates corresponding to the plurality of signal cycles, and accumulating count rates in the initial series of count rates over a selected number of count rates to provide the first series of count rates.

In another aspect, the disclosure herein provides an apparatus that may include: a frequency generator configured to provide reference frequency signals; and a multiphase counter configured to provide a count rate for each timing signal corresponding to a plurality of signal cycles of a measurement signal obtained from a sensor, using the reference frequency. In another aspect, the apparatus may further include an edge pipe control unit that generates timing signals corresponding to the plurality of signal cycles of the measurement signal. In one aspect, the edge pipe control unit may generate the timing signals corresponding to rising and falling edges of the plurality of signal cycles of the measurement signal. The frequency generator may generate the reference frequency signals corresponding to the rising and falling edges of one of: (i) a sensor reference frequency signal; (ii) a boosted sensor reference frequency signal; and (iii) a frequency signal independent of a reference frequency signal of the sensor. In another aspect, the frequency generator may generate the reference frequency signals corresponding to a zero degree phase and a ninety degree phase of a preexisting frequency signal.

In another aspect, the multiphase counter may generate the count rates that comprise alternate count rates corresponding to rising and falling edges of the plurality of signal cycles of the measurement signal. The apparatus may further include a multiplexer that may sequence the count rates from the multiphase counter to provide a series of count rates that includes alternate count rates corresponding to the rising and falling edges of the plurality of signal cycles of the measurement signal. A suitable filter may be utilized to reduce phase noise from the measurement signal using the series of count rates provided by the multiplexer and to provide a reduced phase noise series of count rates. A measurement device may be utilized to reconstruct the measurement signal from the reduced phase noise series of count rates provided by the filter. In another aspect, the multiphase counter may include a plurality of channels, each channel having a plurality of phases.

In another aspect, the disclosure provides a tool for use in a wellbore. The tool in one configuration may include: a sensor configured to obtain a measurement downhole and to provide a corresponding measurement signal having a plurality of signal cycles; a device configured to reduce phase noise from the measurement signal, the device including a frequency generator configured to provide reference frequency signals; and a multiphase counter configured to provide a count rate for each timing signal corresponding to the plurality of signal cycles using the reference frequency signal. The tool may further include a filter that reduces phase noise from the measurement signal using the count rates provided by the multiphase counter. The sensor may be any sensor, including, but not limited to, a pressure sensor and a temperature sensor.

In yet another aspect, an apparatus is provided to generate a selected sample rate, which apparatus in one embodiment may include: a circuit configured to: receive sensor signals as a first series of count rates corresponding to sensor measurements, each count rate representing a value of the parameter of interest; at least two accumulators configured to alternately accumulate the count rates in the series of count rates over a time period that corresponds to a selected sample rate; and a controller configured to control the time periods for the at least two accumulators.

In one aspect, each signal in the first series of count rates is a numerical value of the parameter of interest. The parameter of interest may be one of pressure and temperature. The apparatus further includes a multiplexer configured to output the accumulated count rates from the at least two accumulators to provide a selected number of samples per second. The apparatus may also include a circuit configured to accumulated the samples on first in first out basis over a selected number of samples to provide the selected number of accumulated samples per second. The apparatus may further include a circuit configured to select samples from the accumulated samples to provide a selected sample rate per second.

In one aspect, the apparatus includes a phase resolution circuit configured to process signals from the sensor to provide the first series of count rates for use by the at least two accumulators that have improved resolution. The phase resolution circuit may be a multiphase counter.

In another aspect, the disclosure provides an apparatus for use in a wellbore that includes a sensor configured to provide measurement signals as a series of count rates; at least two accumulators configured to alternately accumulate the count rates in the series of count rates to provide a first series of samples per unit time; and a controller configured to control the time periods for the at least two accumulators. The apparatus may include a circuit configured to accumulate the first series of samples on a first-in-first-out basis pipe lined manner to provide a second series of samples per unit time, and select the samples from the pipelined samples to provide a selected number of sample per unit time.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

What is claimed is:

1. A method of increasing a resolution of a sensor measurement, comprising:

using a sensor to provide the sensor measurement;

selecting a sample rate for the sensor measurement;

receiving a signal from a counter as a first series of count rates corresponding to the sensor measurement, each count rate representing a value of a parameter of interest;

alternating accumulation of the count rates directly from the counter between at least two accumulators over alternating time periods, wherein the time periods correspond to the sample rate; and outputting the alternately accumulated count rates to provide sensor measurements corresponding to the selected sample rate as a second series of count rates to increase a resolution of the sensor measurement.

2. The method of claim 1, wherein each signal in the first series of count rates is a numerical value of the parameter of interest.

3. The method of claim 1, wherein the parameter of interest is one of pressure and temperature.

4. The method of claim 1 further comprising using a controller to control the time periods for each of the at least two accumulators.

5. The method of claim 1 further comprising serially accumulating a selected number of the count rates from the second series of count rates on a first in first out basis to provide a third series of count rates.

6. The method of claim 5 further comprising selecting the count rates from the third series of count rates as the measured values of the parameter of interest by the sensor.

7. The method of claim 1, wherein the first series of count rates is obtained by:

receiving a signal from the sensor having a plurality of signal cycles;

using a multiphase counter based on a reference frequency to generate an initial series of count rates corresponding to the plurality of signal cycles; and accumulating count rates in the initial series of count rates over a selected number of count rates to provide the first series of count rates.

8. The method of claim 7, wherein the reference frequency is one of: (i) a reference frequency of the sensor; (ii) a boosted reference frequency of the sensor; and (iii) a frequency generated independent of a sensor reference frequency.

9. The method of claim 7 further comprising:

generating a plurality of timing signals corresponding to the plurality of signal cycles; and providing the plurality of the timing signals to the multiphase counter.

10. The method of claim 9, wherein generating the plurality of timing signals comprises generating timing signals corresponding to rising edges and falling edges of the signal cycles in the plurality of signal cycles.

11. A sensor apparatus, comprising:

a sensor configured to provide a sensor measurement;

a circuit configured to:

receive a sensor signal from a counter as a first series of count rates corresponding to the sensor measurement, each count rate representing a value of the parameter of interest;

at least two accumulators configured to alternately accumulate the count rates in the series of count rates directly from the counter over alternating time periods, wherein the time periods correspond to a selected sample rate and output a second series of count rates to increase a resolution of the sensor measurement; and a controller configured to control the time periods for the at least two accumulators.

12. The apparatus of claim 11, wherein each signal in the first series of count rates is a numerical value of the parameter of interest.

13. The apparatus of claim 11, wherein the parameter of interest is one of pressure and temperature.

14. The apparatus of claim 11 further comprising a multiplexer configured to output the accumulated count rates from the at least two accumulators to provide a selected number of samples per second.

15. The apparatus of claim 14 further comprising a circuit configured to accumulate the samples on a first-in-first-out basis over a selected number of samples to provide the selected number of accumulated samples per second.

16. The apparatus of claim 15 further comprising a circuit configured to select samples from the accumulated samples to provide a selected sample rate per second.

17. The apparatus of claim 11 further comprising:

a phase resolution circuit configured to process the signal from the sensor to provide the first series of count rates for use by the at least two accumulators that have improved resolution.

18. The apparatus of claim 17, wherein the phase resolution circuit includes a multiphase counter.

19. An apparatus for use in a wellbore, comprising:

a tool configured for deployment into the wellbore, the tool including:

a sensor configured to provide a measurement signal;

a counter configured to provide as a first series of count rates corresponding to the measurement signal;

at least two accumulators configured to alternately accumulate the first series of count rates in the series of count rates directly from a counter over alternating time periods to provide a second series of samples per unit time to increase a resolution of the measurement signal; and a controller configured to control the time periods for the at least two accumulators.

20. The apparatus of claim 19 further comprising:

a circuit configured to accumulate the first series of samples on a first-in-first-out basis pipe lined manner to provide a second series of samples per unit time, and select the samples from the pipelined samples to provide a selected number of sample per unit time.

* * * * *